US012474144B2

(12) United States Patent
Laporte et al.

(10) Patent No.: US 12,474,144 B2
(45) Date of Patent: Nov. 18, 2025

(54) THROWING ARM

(71) Applicant: LAPORTE HOLDING, Biot (FR)

(72) Inventors: Jean-Michel Laporte, Biot (FR); Jean-Marc Fouques, Antibes (FR)

(73) Assignee: LAPORTE HOLDING, Biot (FR)

( * ) Notice: Subject to any disclaimer, the term of this patent is extended or adjusted under 35 U.S.C. 154(b) by 124 days.

(21) Appl. No.: 18/264,313

(22) PCT Filed: Feb. 28, 2022

(86) PCT No.: PCT/EP2022/055004
§ 371 (c)(1),
(2) Date: Aug. 4, 2023

(87) PCT Pub. No.: WO2022/184649
PCT Pub. Date: Sep. 9, 2022

(65) Prior Publication Data

US 2024/0302142 A1 Sep. 12, 2024

(30) Foreign Application Priority Data

Mar. 3, 2021 (FR) ..... 2102062

(51) Int. Cl.
*F41J 9/20* (2006.01)
*F41J 9/18* (2006.01)

(52) U.S. Cl.
CPC .. *F41J 9/20* (2013.01); *F41J 9/18* (2013.01)

(58) Field of Classification Search
CPC . F41J 9/20; F41J 9/18; F41J 9/22; F41J 9/24; F41J 9/28; A63B 69/408
See application file for complete search history.

(56) References Cited

U.S. PATENT DOCUMENTS 1,178,371 A * 4/1916 Adams ..... F41J 9/20 124/43
3,368,542 A * 2/1968 Dale ..... F41J 9/20 124/43

(Continued)

FOREIGN PATENT DOCUMENTS

FR 2696538 A1 4/1994
FR 3048772 A1 9/2017
GB 993310 * 5/1965 ..... F41J 9/20

OTHER PUBLICATIONS

International Search Report issued in corresponding International Application No. PCT/EP2022/055004, dated May 10, 2022, pp. 1-2, European Patent Office, Rijswijk, Netherlands.

(Continued)

*Primary Examiner* — John E Simms, Jr.
(74) *Attorney, Agent, or Firm* — HAUPTMAN HAM, LLP

(57) ABSTRACT

A target throwing device, including a support, a throwing arm and a tray, wherein the throwing arm is rotatably hinged relative to the support according to an axis of rotation, so as to be able to eject a target arranged on the tray, and wherein the arm includes an elongate member and a damping element mounted on the elongate member and able to come into contact with the target, the elongate member includes at least one section according to its lengthwise dimension having, in section according to a plane perpendicular to the direction of extension, a first indentation and a second indentation arranged on either side of a core, the core being directed according to the direction of rotation and in that the damping element is fastened in the first indentation.

11 Claims, 6 Drawing Sheets

(56) References Cited

U.S. PATENT DOCUMENTS

| | | | | | |
|---|---|---|---|---|---|
| 3,601,112 | A * | 8/1971 | Dale | F41J 9/20 | 124/80 |
| 3,971,357 | A * | 7/1976 | LaPorte | F41J 9/24 | 124/43 |
| 4,361,533 | A * | 11/1982 | Jenks | B29D 99/0003 | 156/173 |
| 10,545,011 | B1 * | 1/2020 | Collins | F41J 9/18 | |
| 2013/0174818 | A1 * | 7/2013 | Tingey | F41J 9/28 | 124/5 |
| 2013/0269667 | A1 * | 10/2013 | Laporte | F41J 9/18 | 124/6 |
| 2021/0038965 | A1 * | 2/2021 | Shirley | A63B 69/408 | |
| 2021/0131769 | A1 * | 5/2021 | Johannaber | F41J 9/28 | |

OTHER PUBLICATIONS

Written Opinion issued in corresponding International Application No. PCT/EP2022/055004, dated May 10, 2022, pp. 1-6, European Patent Office, Rijswijk, Netherlands.

* cited by examiner

THROWING ARM

The present application is a U.S. National Phase of International Application Number PCT/EP2022/055004, filed Feb. 28, 2022, which claims priority to French Application No. 2102062, filed Mar. 3, 2021.

TECHNICAL FIELD OF THE INVENTION

The present invention relates to the field of target throwers for sport shooting practices. It finds a particularly advantageous application in practices like ball-trap and derivative activities.

PRIOR ART

Many thrower solutions propose devices wherein an arm is rotatably hinged, a target is positioned on a tray, and through a rotational movement of the arm, the target is pushed by the arm and consequently ejected off the device according to a predetermined trajectory.

For the ejection to take place, the push should be strong enough to enable a shooter to give a try. The push could have a tendency to break up the target. Indeed, for these practices, the used projectiles are particularly fragile in order to fill their function. One of the challenges of the solutions in this field is to enable an ejection over a large distance without breaking the target. For this purpose, coatings or damping elements are positioned at the tip of the arm.

The patent application FR2696538A1 is known from the prior art, wherein a target throwing apparatus for shooting is disclosed comprising a throwing tray on which at least one target is positioned, a throwing arm comprising a damping element, and configured so as to be able to be movable in rotation according to an axis relative to the throwing tray, the arm being set in accelerated movement using a spring which triggers the movement until contact between the damping element and the target, and finally the ejection.

The projection of the target is due in particular to the angular acceleration of the throwing arm. During a throwing cycle, it happens that the arm performs a 360 degree rotation from a starting position. The initial velocity is then zero and the acceleration occurs over a first angular sector of about 130 degrees. During this phase, the target rolls along an elastomer secured to the arm up to its end where the ejection of the target takes place. In general, the used energy originates from the expansion of a spring. A connecting rod may ensure the connection between the spring and the arm. Tensioning the spring may be done by a gearmotor whose end is in contact with the connecting rod. In general, the expansion of the spring occurs when crossing an equilibrium point. One of the challenges of these throwing systems is to increase the ejection distance. One solution consists in increasing the rotational speed by increasing the stiffness of the spring. Yet this requires an increase of the power of the gearmotor as well as a reinforcement of the idle wheel. Another technical solution consists in increasing the length of the arm. In general, the arm being a solid profile with a rectangular section and made of an aluminium alloy, an increase in the latter is accompanied with an increase of its mass at the periphery and increases the inertia of the mechanism which could lead to an unbalance of the system.

Hence, an object of the present invention is to provide a solution that allows improving the projection phase, and in particular increasing the ejection distance without increasing the power of the gearmotor while preserving a good stability of the device, or performing a projection over common distance in better conditions, for example by reducing bending of the arm or its inertia, or the power of the gearmotor.

The other objects, features and advantages of the present invention will appear upon examining the following description and the appended drawings. It is understood that other advantages can be incorporated therein.

SUMMARY OF THE INVENTION

To achieve this objective, according to one embodiment, a target throwing device is provided, comprising a support, an arm and a tray, wherein the arm is rotatably hinged relative to the support according to an axis of rotation $A_z$, directed along a direction of rotation (z), so as to be able to eject a target arranged on the tray, and wherein the arm comprises:

an elongate member having:

i. a lengthwise dimension extending according to a direction of extension x perpendicular to the direction of rotation z, ii. a widthwise dimension extending according to a transverse direction y, perpendicular to the direction of extension x and perpendicular to the direction of rotation z, iii. a height dimension extending according to the direction of rotation z, a damping element mounted on the elongate member and able to come into contact with the target, a device wherein the elongate member comprises at least one section according to its lengthwise dimension having, in section according to a plane perpendicular to the direction of extension x, a first indentation and a second indentation arranged on either side of a core, the core being directed according to the direction of rotation z and wherein the damping element is fastened in the first indentation.

Without this device, a longer arm should for example be used, or the power transmitted by an actuator-spring to the arm is increased. Indeed, a longer arm according to the direction of extension allows for a higher velocity at the tip of the arm, which is necessarily accompanied with a higher acceleration and thus a stronger projection of the target.

Reducing the inertia of the arm is made possible by reducing its mass. This mass reduction results from a first indentation and from a second indentation. The dimension of the arm may be kept according to the direction of extension x. Advantageously, the damping element is positioned and fixed in the first indentation.

Thus, the device allows avoiding changing the material and advantageously enables an identical resistance to bending.

Hence, the device preferably allows obtaining an increase in the projection distance of a target thrower by reducing the mass of the throwing arm.

According to one example, in order to increase the projection distance, it will be possible to both increase the length of the arm, and limit the bending deformation of the arm by widening its base. More specifically, one object is to propose an improvement of the throwing arm.

BRIEF DESCRIPTION OF THE FIGURES

The aims, purposes, characteristics and advantages of the invention will be better understood upon reading the detailed description of one embodiment thereof, which is illustrated by means of the following accompanying drawings, in which.

Figure 1A:
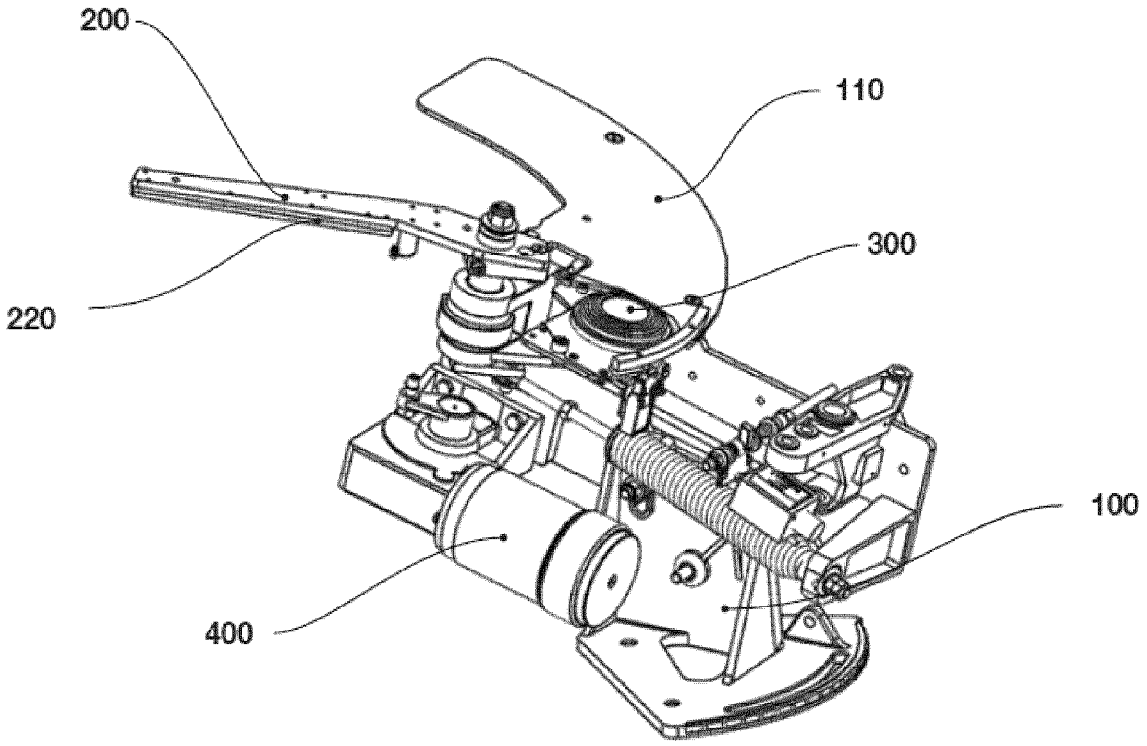
FIG. 1A shows an example of a target thrower of the prior art.

The drawings are provided by way of example and are not intended to limit the scope of the invention. They constitute diagrammatic views intended to ease the understanding of the invention and are not necessarily to the scale of practical applications.

DETAILED DESCRIPTION

Before starting a detailed review of embodiments of the invention, optional features that may be used in combination or alternatively are set out hereinafter:

According to one example, the elongate member 210 comprises a first wing 214, a second wing 215, a third wing 216 and a fourth wing 217, the wings being directed according to the transverse direction y.

According to one example, the first wing 214 comprises a first inner wall 214*a*, the second wing 215 comprises a second inner wall 215*a* and the first indentation 211 extends according to the direction of extension x and is delimited by the first inner wall 214*a*, by the second inner wall 215*a* and by a central wall 213*a* extending from the first inner wall 214*a* up to the second inner wall 215*a*.

According to one example, the damping element 220 comprises a mounting portion 222 and a contact portion 221, so that the mounting portion 222 comprises coupling surfaces 222*b*, 222*c* configured so as to be able to cooperate by coupling with the first inner wall 214*a* and a stop wall 214*c* of the first wing 214, in particular to enable positioning of the damping element 220 in contact with an edge of the first wing 214.

According to one example, the damping element 220 is made of an elastomeric material for example of EPDM 70 Shore and extends according to the direction of extension x and/or the elongate member 210 is made of an aluminium alloy like for example an ($AlZn_5$, 5MGCu) 7075 alloy.

According to one example, according to the direction of rotation z, the dimension of the arm $z_{200}$ is equal to the height dimension of the elongate member $z_{210}$, preferably equal to 12 mm.

According to one example, the elongate member 210 has a lower face 210*b* and the damping element 220 has a lower damping face 220*b* so that the lower face 210*b* and the lower damping face 220*b* are coplanar.

According to one example, the elongate member comprises a section with a width variable and decreasing when getting away from the axis of rotation Az.

According to one example, the contact portion 221 comprises a planar contact surface 221*c*, configured to be directed inwardly of the rotational movement of the throwing arm 200 during the target 300 ejection phase, and perpendicular to the transverse direction y.

According to one example, the core 213 is a parallelepipedic plate comprising a midplane parallel to both the direction of extension x and the direction of rotation z, and the elongate member 210 and a part having a shape symmetry according to said midplane.

According to one example, the distance between the first inner wall 214*a* and the second inner wall 215*a* is larger than 4 mm, preferably larger than 6 mm and preferably larger than 8 mm.

According to one example, in section, according to a plane perpendicular to the direction of extension x, the thickness of the core 213 is equal to the respective thickness of the four wings 214, 215, 216, 217, preferably equal to 2 mm.

It is specified that in the context of the present invention, the term "thrower" is sometimes used instead of "machine" as a claimed object, these terms should be considered as equivalent.

In the context of the invention, by "radial orientation" or "radially", reference is made to the positioning of an element movable in rotation relative to an axis.

The terms "substantially", "about", "in the range of" mean "within a 10% margin, preferably within a 5% margin" or, when it consists of an angular orientation, "within a 10° margin". Thus a direction substantially normal to a plane means a direction having an angle of 90±10° with respect to the plane.

In the following description, the term "over" does not necessarily mean "directly over". Thus, when it is indicated that a part or a member A bears "on" a part or a member B, this does not mean that the parts or members A and B are necessarily in direct contact with the other. These parts or members A and B can either be in direct contact or bear on one another through one or more other part(s). The same applies for other expressions such as the expression "A acts on B" which could mean "A acts directly on B" or "A acts on B through one or more other part(s)".

In the present disclosure, the term movable corresponds to a rotational movement or to a translational movement or to a combination of movements, for example the combination of a rotation and of a translation.

In the present disclosure, when it is indicated that two parts are distinct, this means that these parts are separate. They are:

- positioned at a distance from each other, and/or
- movable relative to each other and/or
- secured to each other by being fastened by added elements, this fastening being removable or not.

Hence, a one-piece unitary part cannot be formed by two distinct parts.

In the present patent application, the term "secured" used to describe the connection between two parts means that the two parts are bound/fastened to each other, according to all degrees of freedom, unless stated otherwise. For example, if it is indicated that two parts are secured in translation according to a direction X, this means that the parts could be movable relative to each other except according to the direction X. In other words, if a part is moved according to the direction X, the other part performs the same movement.

DISCUSSION OF THE PRIOR ART

As illustrated in FIG. 1A and according to an example derived from the prior art, a target throwing device 300 is shown comprising a support 100 on which a tray 110 is positioned. A throwing arm 200 is rotatably hinged relative to the support 100 and according to an axis of rotation Az. The target 300 is able to be positioned on the tray 110. Preferably, a spring system triggers an accelerated movement of the throwing arm 200 according to the direction of rotation z and thus drives the throwing arm 200 in contact with the target 300. This contact may be assimilated to a push, wherein a kinetic energy transmission is performed from the arm towards the target 300 in order to enable a projection of the latter according to a predetermined trajectory.

The throwing arm 200 comprises a damping element 220 configured to preferably be positioned at the tip of the arm in order to dampen the contact between the throwing arm 200 and the target 300 and thus create an adherence surface. Without the presence of the damping element 220, contact between the throwing arm 200 and the target 300 may result in cracking of the target 300. Indeed, this type of devices is intended for target 300 throws for sport shooting and these targets 300 are made of a brittle material which should be able to fall apart upon contact with a projectile which could be a lead sheaf.

Figure 1B:
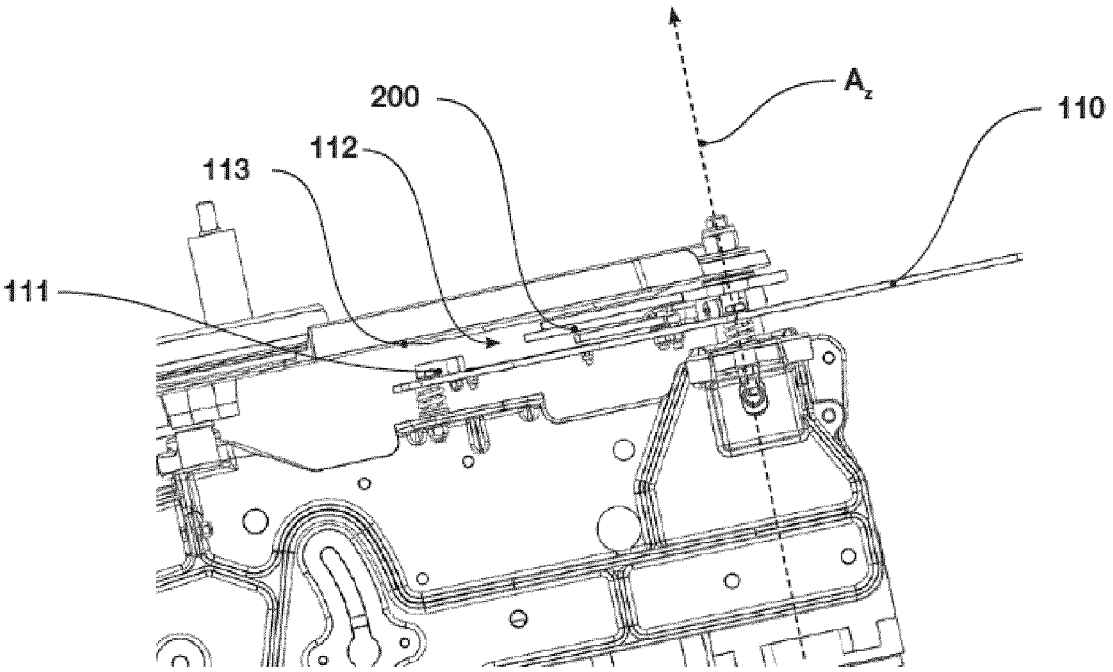
FIG. 1B shows an example of a throwing area of a target thrower of the prior art.
Figure 1C:
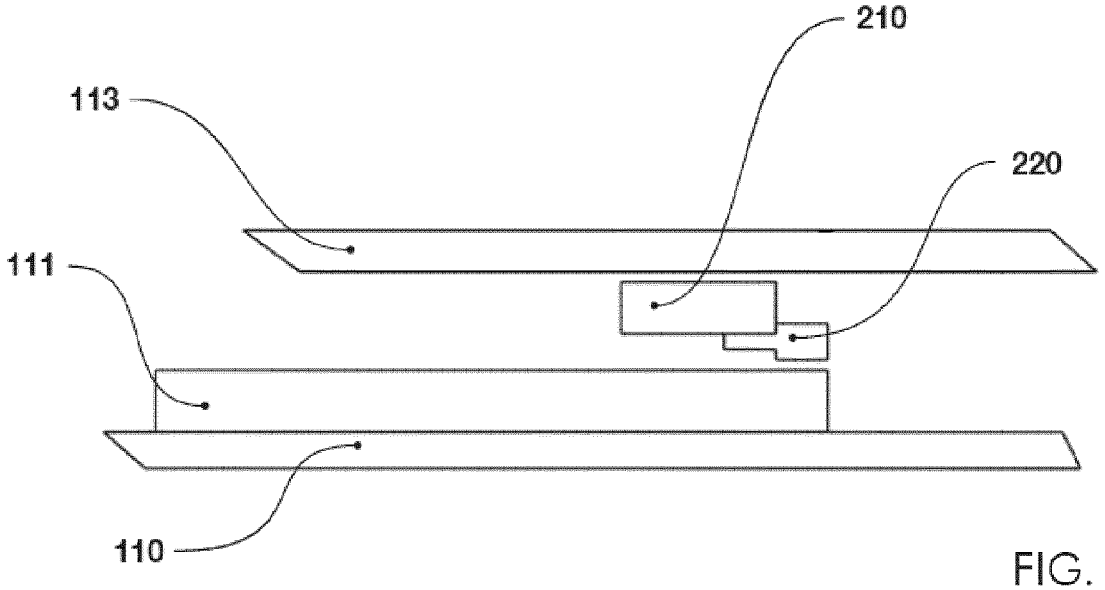
FIGS. 1C to 1D show a sectional view enlarged on an example of a throwing area of a thrower of the prior art.

As illustrated in FIGS. 1B and 1C, and according to an example of the prior art, a throwing area 112 is limited vertically between a revolving cylinder support plate 113 and the tray 110, and horizontally between a comma-like part 111 and the throwing arm 200.

Figure 1D:
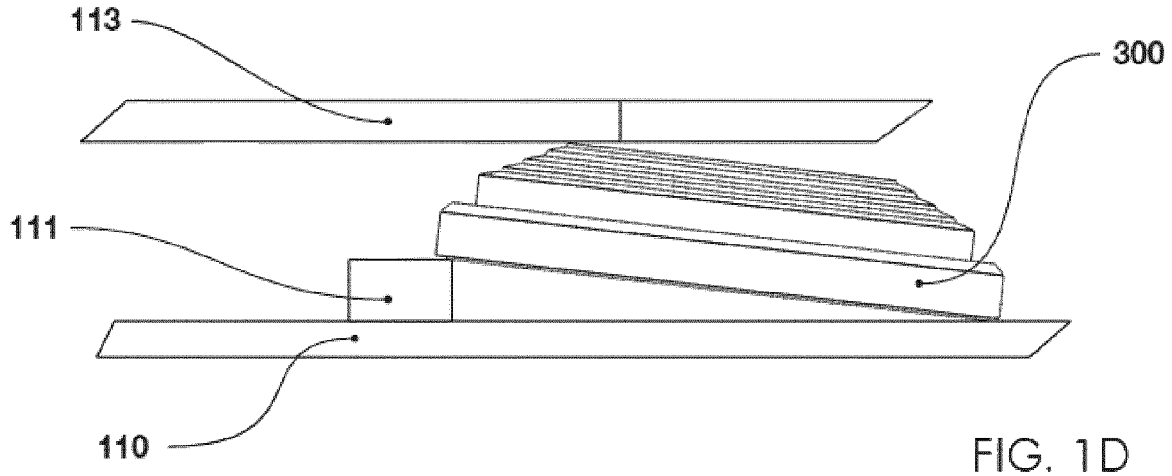

As illustrated in FIG. 1D and according to an example of the prior art, the target 300 tends to jam between the revolving cylinder support plate 113 and the comma-like part 111 and in these cases, the target 300 generally cracks by the action of the throwing arm 200 in the throwing area 112.

Figure 2A:
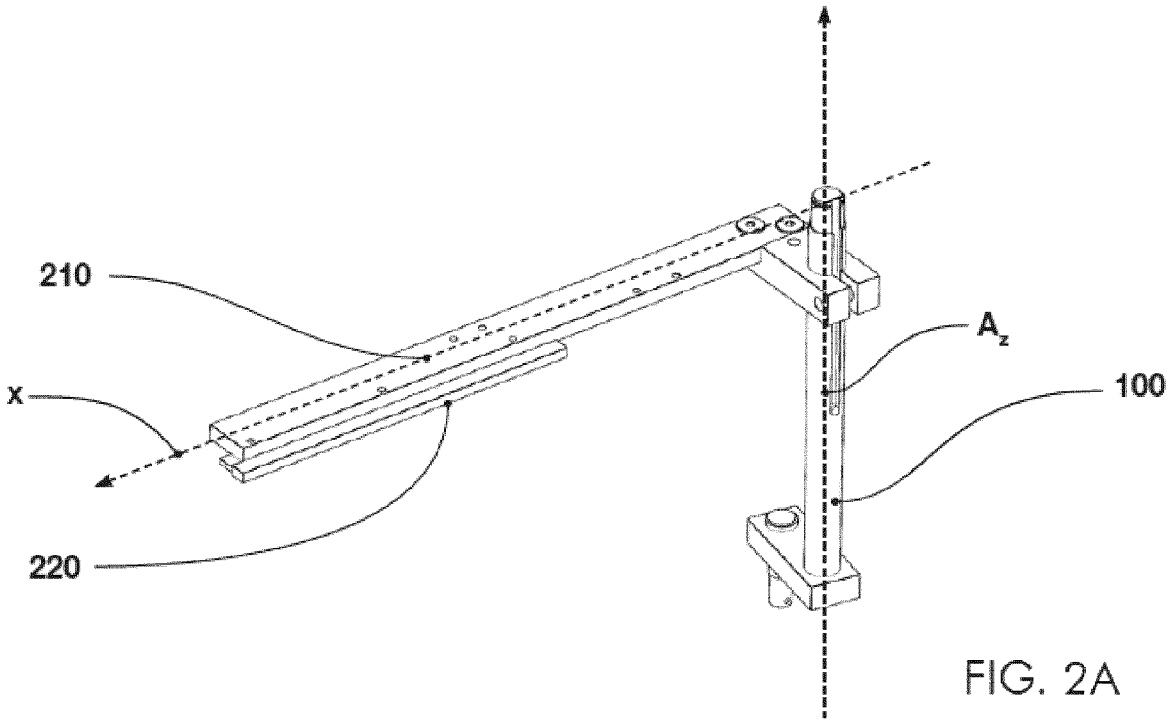
FIG. 2A shows a simplified device with a throwing arm including an elongate member and a damping element.

As illustrated in FIG. 2A and according to a simplified example of the prior art, it may consist of a throwing arm 200 wherein the elongate member 210 and the damping element 220 could be found.

Preferably, the support 100 is fixed with respect to the ground during the throwing phase. In FIG. 2A, it is possible to have the cooperation between the damping element 220 and the elongate member 210 distribute according to the direction of extension.

Figure 2B:
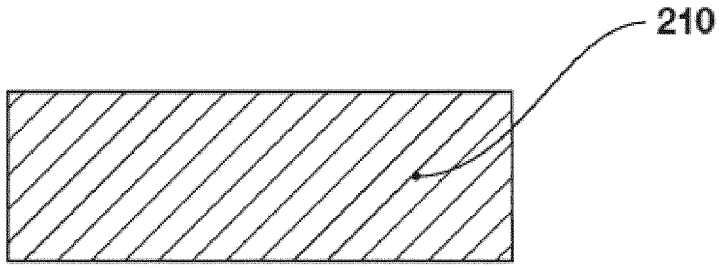
FIGS. 2B to 2C show a sectional view of a throwing arm of the simplified device of FIG. 2A, with the arm alone in FIG. 2B and with the damping element configured to be positioned against the elongate member in FIG. 2C.
Figure 2C:
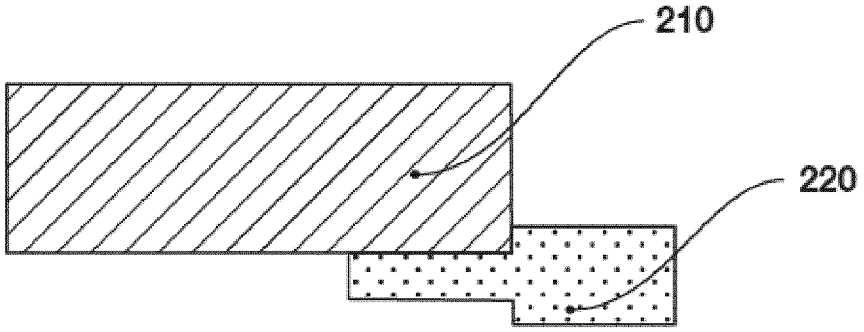

As illustrated in FIGS. 2B and 2C, and according to this same example, the elongate member 210 is a part that extend between a pivot joint enabling a rotational movement with the support and a free end configured to be able to fix a damping element 220. The elongate member 210 may be a solid profile, possibly with a constant rectangular section and made of a rigid material, like for example a metallic alloy.

As illustrated in FIG. 2C, and according to the same example, the damping element 220 is positioned below the elongate member 210. The damping element 220 comprises at least one face, in plane-over-plane contact with the elongate member 210. In this example, in order to guarantee a proper positioning of the damping element 220 on the elongate member 210, these last two are configured to be in plane-over-plane contact through two respective adjacent surfaces.

The damping element 220 is positioned under the throwing arm 200 so that it could touch the tray 110 in order to allow for the best possible contact upon contact thereof with the target 300. Such a positioning of the damping element 220 on the elongate member 210 increases the height dimension $z_{200}$ of the arm.

In order to enable a farthest projection of the target, the velocity of the arm 200 should be increased.

Preferred Embodiment

The present invention allows increasing the velocity of the arm by reducing its mass. This mass reduction results from a first indentation 211 and from a second indentation 212. The dimension of the throwing arm 200 remains unchanged compared to the solution of the prior art according to the direction of extension x. Advantageously, the damping element is positioned and fixed in the first indentation 211.

Figure 3A:
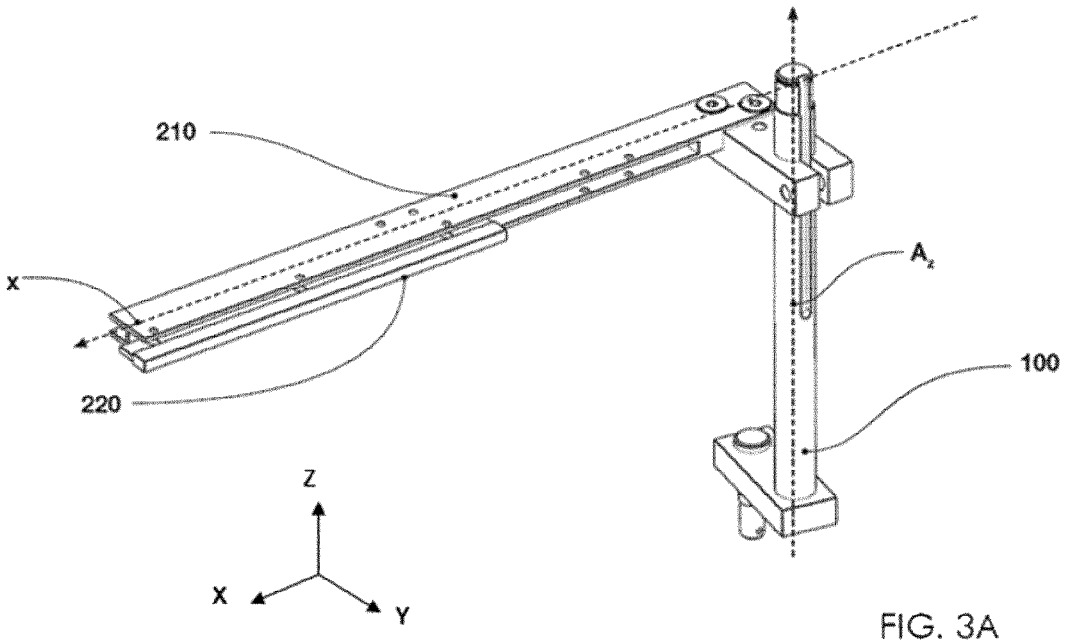
FIG. 3A shows a simplified device according to the invention with a throwing arm including an elongate member and a damping element.

As illustrated in FIG. 3A and according to a preferential embodiment of the present invention. The throwing arm 200, rotatably hinged relative to the support 100 according to the axis of rotation $A_z$ comprises an elongate member 210 and a damping element 220, both securely mounted.

Figure 3B:
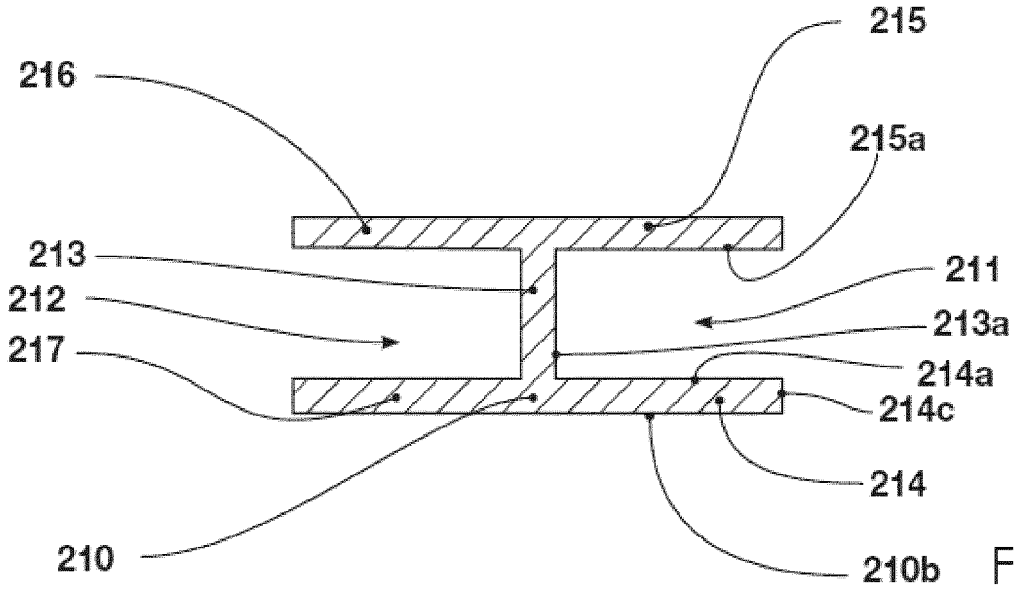
FIGS. 3B to 3C show a sectional view of a throwing arm of the simplified device of FIG. 3A with the damping element configured to be positioned against the elongate member.

As illustrated in FIG. 3B, in section according to a plane perpendicular to the direction of extension x, the elongate member 210 comprises a first indentation 211 as well as a second indentation 212 distributed around a core 213. Preferably, the elongate member 210 comprises a first wing 214, a second wing 215, a third wing 216 as well as a fourth wing 217 distributed around the core 213. Preferably, this distribution is homogeneous so that the first wing 214 and the second wing 215 are symmetrical with respect to the third wing 216 and the fourth wing 217.

Figure 3C:
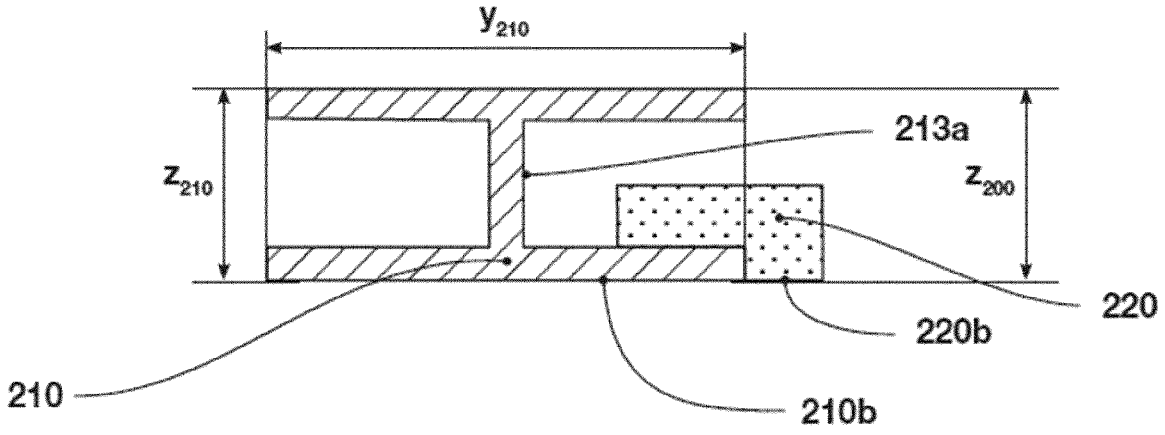
Figure 3D:
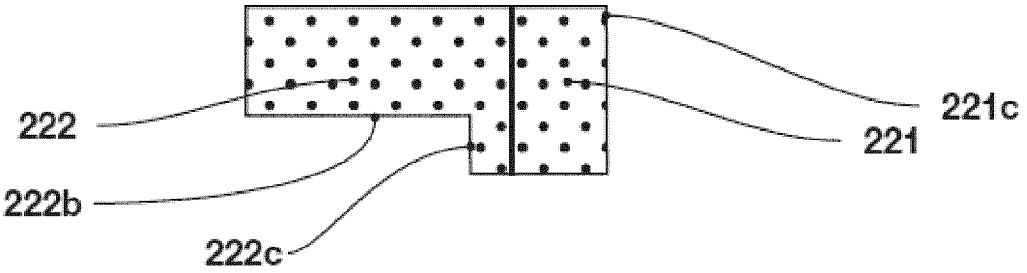
FIG. 3D shows a sectional view of the damping element and its different functional areas.
Figure 4:
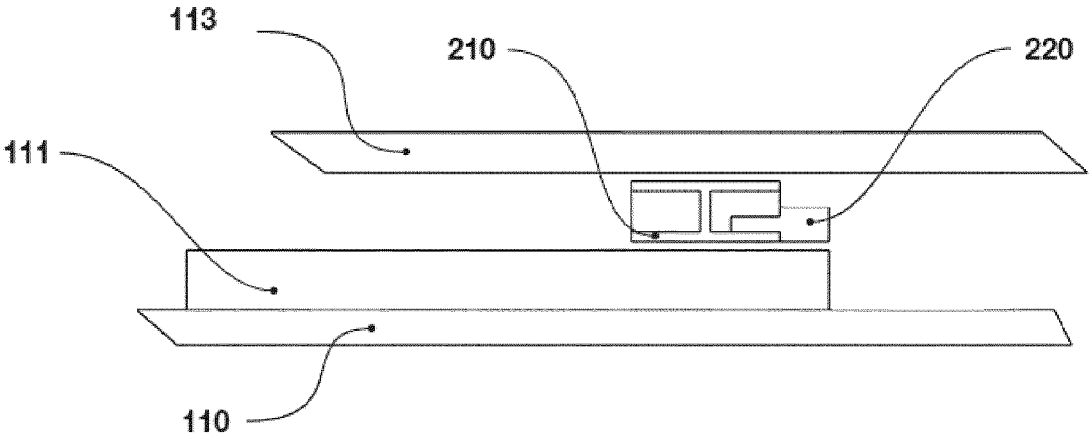
FIG. 4 shows a sectional view enlarged on an example of the throwing area of a thrower according to the present invention.

As illustrated in FIGS. 3B to 3D and according to a particular embodiment of the invention, the damping element 220 comprises a contact portion 221 and a mounting portion 222. The mounting portion 222 is configured so as to be positioned in contact with the first wing 214.

Preferably, the first wing 214 comprises a first inner wall 214*a* and the mounting portion 222 comprises a first coupling surface 222*b* configured so that the first inner wall 214*a* comes into plane-over-plane contact with the first coupling surface 222*b*.

Advantageously, the first wing 214 comprises a stop wall 214*c* and the mounting portion 222 comprises a second coupling surface 222*c* configured so that the stop wall 214*c* comes into plane-over-plane contact with the second coupling surface 222*c*.

Advantageously, the cooperation between the damping element 220 and the elongate member 210 is optimised such that the elongate member 210 comprises a lower face 210*b* and the damping element comprises a lower damping face 220*b* so that the lower damping face 220*b* and the lower face 210*b* are preferably coplanar when the damping element 220 is secured to the elongate member 210.

As illustrated in FIG. 3D and according to one example, the damping element 220 comprises a contact portion 221 and a mounting portion 222. The contact portion 221 comprises a contact surface 221*c* configured to be in contact with the target 300 during the target 300 ejection phase.

Preferably, contact between the first wing 214 and the damping element 220 comprises at least one contact by the edge of the first wing 214, so that the forces applied by the reaction of a target upon projection on the damping element 220 is taken up, at the rear, by said edge. And thus, a compressive deformation of the damping element 220 at this level, which makes arrangement thereof with respect to the target reliable. Preferably, the contact is of the plane-over-plane type.

Alternatively, or complementarily, a contact perpendicular to the loading direction of the damping element 220 by the target may be provided for between the first wing 214 and the damping element 220, in particular at the surface 222*b*. This aspect allows profiting from a potentially large bearing surface between these two elements. Preferably, the contact is of the plane-over-plane type.

According to a preferred embodiment of the present invention, the height dimension of the arm $z_{200}$ is equal to the height dimension of the elongate member $z_{210}$. Thus, the space between the tray 110 and the revolving cylinder support plate 113 may also be reduced which suppresses the likelihood of jamming of the target 300 between the revolving cylinder support plate 113 and the comma-like part 111.

Indeed, according to this same particular embodiment, the height dimension of the damping element $z_{220}$ is smaller than or equal to the height dimension of the elongate member $z_{210}$ so that when the damping element 220 is positioned and is held in position with the elongate member 210, the damping element 220 does not protrude beyond the elongate member 210, according to the direction of rotation z. Thus, the volume of the throwing area 112 is advantageously reduced and a target 300 can no longer be jammed therein. Consequently, a target 300 destruction within the throwing area 112 is avoided and therefore, a maintenance operation intended to put the machine back into working order is also avoided.

Finally, the present invention does not requires changing the material and offers an identical resistance to bending.

Material Strength Approach

According to a particular embodiment, the elongate member 210 is made of a metallic material. Possibly, it could consist of an aluminium alloy, preferably of the "7075" type whose Young's modulus is preferably equal to 72 $N \cdot mm^{-2}$. Preferably, the elongate member 210 is a part made in one-piece.

Furthermore, a force with a normal component directed according to the direction of rotation Z is created at the free end of the arm, as a result of the contact between the throwing arm 100 and the target 300. Hence, the throwing arm 100 should structurally oppose this normal stress resulting from a bending moment.

According to a particular embodiment, in section, according to a plane perpendicular to the direction of extension x, the first indentation 211 and the second indentation 212 are identical and distributed symmetrically on each side of the core 213.

According to the same embodiment, the thickness of the core is equal to the thicknesses of the first wing 214, of the second wing 215, of the third wing 216, as well as of the fourth wing 217. Preferably, this thickness may be equal to 2 mm. Preferably, the elongate member 210 has a height dimension $z_{210}$ according to the direction of rotation z equal to 12 mm and/or has a width dimension according to the transverse direction y equal to 30 mm.

According to this same embodiment, the damping element 220 has a height dimension $z_{220}$ according to the direction of rotation z equal to 6 mm.

According to an example "A", shown in FIGS. 1C, 2A, 2B, 2C and derived from the prior art, the elongate member 210 has a solid rectangular section having height by width dimensions equal to 10 mm×30 mm, a length of 342 mm and a mass of 358 grams. This elongate member 210, according to the direction of extension x is subjected to bending over a length of 307 mm. This results in a quadratic moment $I_x$ of 2,500 $mm^4$ with a maximum deflection at the tip of the arm equal to 0.64 mm.

According to a preferred embodiment of the present invention "B" and shown in FIGS. 3A to 3D, 4 and 5, the elongate member 210 has a section whose dimensions are comprised within a 12 mm×30 mm rectangle and having four wings 214, 215, 216, 217 symmetrically distributed with respect to the core 213. And wherein the thicknesses of the wings and of the core 213 are constant and equal to 2 mm, then the quadratic moment $I_x$ is equal to 3,125 $mm^4$ with a maximum deflection at the tip of the arm equal to 0.51 mm.

Thus, the present invention also allows for a mass reduction, also a better resistance to the stress derived from the bending moment.

Assembly

According to one embodiment, the mounting portion 222 comprises, in turn, openings so as to be able to enable the secure connection of the damping element 220 with the elongate member 210.

Advantageously, this assembly is performed using bending elements which may possibly consist of threaded elements, in particular by screwing.

According to another embodiment, the damping element 220 is fastened to the elongate member 210 using a glue.

Kinematic Approach

According to a particular embodiment, the throwing arm 200 is advantageously driven in rotation by a connecting rod/crank system, itself connected to a spring system, itself actuated by a motor. With the same motor power:

- in the example "A" derived from the prior art shown in FIGS. 1A to 1D, the velocity of the target 300 at the end of the tray 110 may reach 109 km/h. With an inclination of the tray 110 by 15 degrees with respect to a horizontal line parallel to the ground, a projection distance of 70 m is thus obtained.
- in the example "B" derived from the present invention in the example of FIGS. 3A to 3D, the velocity of the target 300 at the end of the tray 110 may reach 119 km/h. With an inclination of the tray 110 by 15 degrees with respect to a horizontal line parallel to the ground, a projection distance of about 95 metres is thus obtained, namely a gain of 25 metres.

Another Embodiment

Figure 5:
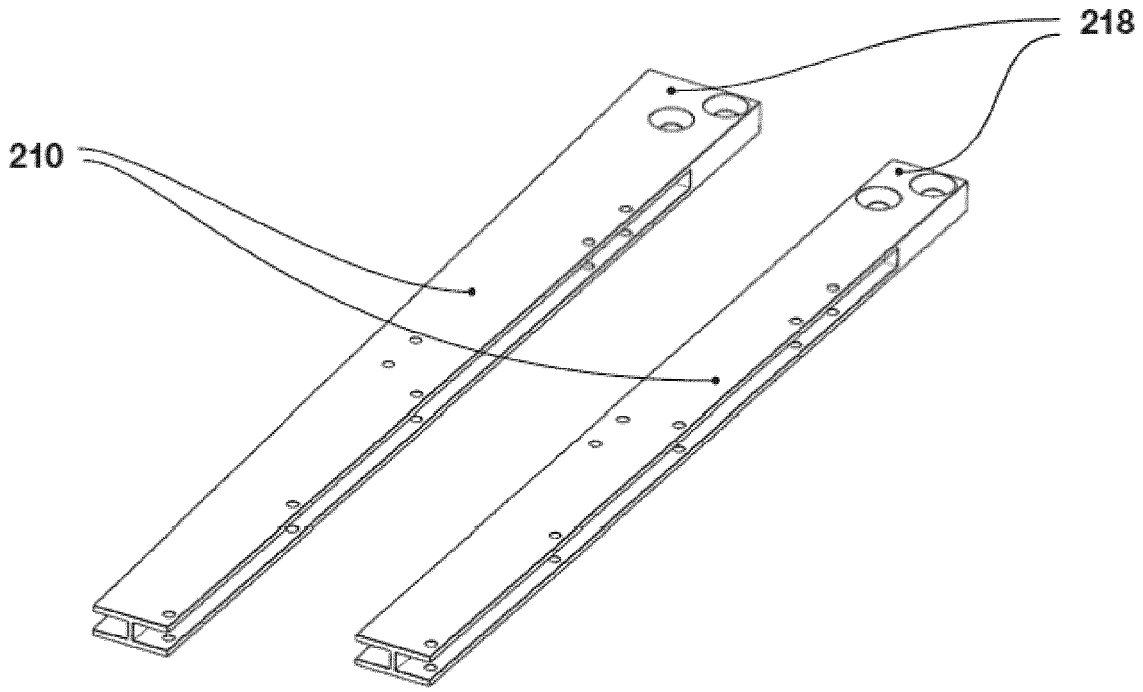
FIG. 5 shows two elongate members according to the present invention.

As illustrated in FIG. 5 and according to a particular embodiment, the throwing arm 200 comprises a base 218 in its portion able to be positioned close to the axis of rotation. Moreover, in order to enable a farther projection of a target, it is also possible, in combination with the present invention, to extend the length of the throwing arm 200 according to the direction of extension x. In general, a larger throwing arm 200 results in a greater deflection at the tip of the arm due to a greater bending moment. To overcome this mechanical deformation, the present invention suggests providing a larger section of the base 218 according to the transverse direction y.

According to one embodiment, the third wing 216 comprises a third inner wall, the fourth wing 217 comprises a fourth inner wall 215*a* and the second indentation 212 extends according to the direction of extension x and is delimited by the third inner wall, by the fourth inner wall and by a second central wall extending from the third inner wall 214*a* up to the fourth inner wall.

According to a particular embodiment, the damping element 220 is made of an elastomeric material which extends like a profile according to a direction of extension x and/or the elongate member 210 is made of an aluminium alloy.

According to a particular embodiment, the contact portion 221 comprises a planar contact surface 221*c*, configured to be directed forwards according to the direction of rotation.

According to a particular embodiment, the articulation of the throwing arm 200 with the support 100 enabling the rotation according to the direction of rotation z is positioned at a first end of the throwing arm 200 and the damping element 220 extends from a second end of the throwing arm 200.

REFERENCE NUMERALS

100. support
110. tray
111. comma-like part
112. throwing area
113. revolving cylinder support plate
200. arm
$z_{200}$. height dimension of the arm
210. elongate member,
$x_{210}$. lengthwise dimension of the elongate member
$y_{210}$. widthwise dimension of the elongate member
$z_{210}$. height dimension of the elongate member
$z_{220}$. height dimension of the damping element
210*b*. lower face
211. first indentation
212. second indentation
213. core,
213*a*. central wall
214. first wing
214*a*. first inner wall
214*c*. stop wall
215. second wing
215*a*. second inner wall
216. third wing
217. fourth wing
218. base
220. damping element
221. contact portion
221*c*. contact surface
220*b*. lower damping face
222. mounting portion
222*b*, 222*c*. coupling surfaces
300. target
400. actuator
x. direction of extension (x)
y. transverse direction (y)
z. direction of rotation (z)
Az. axis of rotation

The invention claimed is:

1. A target throwing device, comprising a support, a throwing arm and a tray, wherein the throwing arm is rotatably hinged relative to the support according to an axis of rotation directed along the direction of rotation, so as to be able to eject a target arranged on the tray, and wherein the arm comprises:

an elongate member having:

a lengthwise dimension extending according to a direction of extension perpendicular to the direction of rotation, a widthwise dimension extending according to a transverse direction, perpendicular to the direction of extension and perpendicular to the direction of rotation, and a height dimension extending according to the direction of rotation; and a damping element mounted on the elongate member and able to come into contact with the target, wherein the elongate member comprises at least one section according to its lengthwise dimension having, in section according to a plane perpendicular to the direction of extension, a first indentation and a second indentation arranged on either side of a core, the core being directed according to the direction of rotation and in that the damping element is fastened in the first indentation, wherein the elongate member comprises a first wing, a second wing, a third wing and a fourth wing, the wings being directed according to the transverse direction, wherein the first wing comprises a first inner wall, the second wing comprises a second inner wall and the first indentation extends according to the direction of extension and is delimited by the first inner wall, by the second inner wall and by a central wall extending from the first inner wall up to the second inner wall, and wherein the damping element comprises a mounting portion and a contact portion, so that the mounting portion comprises coupling surfaces configured so as to be able to cooperate by coupling with the first inner wall and a stop wall located at an edge of the first wing.

2. The device according to claim 1, wherein the damping element is made of an elastomeric material which extends according to the direction of extension and the elongate member is made of an aluminium alloy.

3. The device according to claim 1, wherein, according to the direction of rotation, the dimension of the arm is equal to the height dimension of the elongate member.

4. The device according to claim 1, wherein the elongate member has a lower face and the damping element has a lower damping face so that the lower face and the lower damping face are coplanar.

5. The device according to claim 1, wherein the elongate member comprises a section with a width variable and decreasing when getting away from the axis of rotation.

6. The device according to claim 5, wherein the contact portion comprises a planar contact surface, configured to be directed inwardly of the rotational movement of the throwing arm during the target ejection phase, and perpendicular to the transverse direction.

7. The device according to claim 1, wherein the core is a parallelepipedic plate comprising a midplane parallel to both the direction of extension and the direction of rotation, and the elongate member is a part having a shape symmetry according to said midplane.

8. The device according to claim 1, wherein the distance between the first inner wall and the second inner wall is larger than 4 mm.

9. The device according to claim 1, wherein, in section, according to a plane perpendicular to the direction of extension, the thickness of the core is equal to the respective thickness of the four wings.

10. The device according to claim 1, wherein, in section, according to a plane perpendicular to the direction of extension, the thickness of the core is equal to 2 mm.

11. A target throwing device, comprising a support, a throwing arm and a tray, wherein the throwing arm is rotatably hinged relative to the support according to an axis of rotation directed along the direction of rotation, so as to be able to eject a target arranged on the tray, and wherein the arm comprises:

an elongate member having:

a lengthwise dimension extending according to a direction of extension perpendicular to the direction of rotation, a widthwise dimension extending according to a transverse direction, perpendicular to the direction of extension and perpendicular to the direction of rotation, and a height dimension extending according to the direction of rotation; and a damping element mounted on the elongate member and able to come into contact with the target, wherein the elongate member comprises at least one section according to its lengthwise dimension having, in section according to a plane perpendicular to the direction of extension, a first indentation and a second indentation arranged on either side of a core, the core being directed according to the direction of rotation and in that the damping element is fastened in the first indentation, and wherein the elongate member has a lower face and the damping element has a lower damping face so that the lower face and the lower damping face are coplanar.

* * * * *